US006497331B1

(12) United States Patent
Morandi

(10) Patent No.: US 6,497,331 B1
(45) Date of Patent: Dec. 24, 2002

(54) METAL WIRE SHELF WITH COLLAPSIBLE SIDES, PARTICULARLY FOR TROLLEYS AND THE LIKE

(75) Inventor: Ivano Morandi, Vacallo (CH)

(73) Assignee: Metaltex Italia S.p.A., Maslianico (IT)

( * ) Notice: Subject to any disclaimer, the term of this patent is extended or adjusted under 35 U.S.C. 154(b) by 0 days.

(21) Appl. No.: 09/632,004

(22) Filed: Jul. 31, 2000

(30) Foreign Application Priority Data

Jan. 11, 2000 (IT) ..... MI0000A17

(51) Int. Cl.[7] ..... A47F 5/08

(52) U.S. Cl. ..... 211/153; 211/90.02; 211/181.1; 211/149; 211/90.03

(58) Field of Search ..... 211/153, 134, 211/186, 90.03, 187, 188, 149, 150, 90.01, 104, 126.6, 126.9, 132.1, 133.6, 189, 195, 181.1, 41.4–41.6, 72; 206/517; 108/34, 91, 96, 97, 100, 101, 106, 107, 162, 163, 115, 147.11; 248/560, 603, 604, 614, 634, 230.7, 230.8, 228.7, 228.8, 231.8; 403/220

(56) References Cited

U.S. PATENT DOCUMENTS

| | | | | |
|---|---|---|---|---|
| 1,648,025 A | * | 11/1927 | Molloy | |
| 2,395,542 A | * | 2/1946 | Fordon | |
| 2,903,137 A | | 8/1959 | Brown | 211/26 |
| 2,994,463 A | * | 8/1961 | Drader | 211/133.2 |
| 3,388,808 A | * | 6/1968 | Radek | 211/132 |
| 3,404,783 A | * | 10/1968 | Whitman et al. | 211/88 |
| 3,489,385 A | * | 1/1970 | Dill, Jr. | |
| 3,568,877 A | * | 3/1971 | Mastrud, Jr. | 211/132 |
| 3,977,529 A | * | 8/1976 | Stroh | 211/187 |
| 4,169,416 A | * | 10/1979 | Haynes et al. | 108/26 |
| 4,595,106 A | * | 6/1986 | Kunze et al. | 211/162 |
| 4,765,495 A | * | 8/1988 | Bisk | 211/181.1 |
| 4,858,773 A | * | 8/1989 | Zimmerman | 211/195 |
| 4,978,013 A | * | 12/1990 | Hogg | 211/181.1 |
| 5,036,778 A | * | 8/1991 | Briosi | 108/110 |
| 5,074,223 A | * | 12/1991 | Remmers | 108/91 |
| 5,213,221 A | * | 5/1993 | Raye, Sr. | 211/195 |
| 5,597,077 A | * | 1/1997 | Hartmann | 211/134 |
| 5,671,857 A | * | 9/1997 | Stromberg | 206/505 |
| 5,688,034 A | * | 11/1997 | Kojima | 211/181.1 |
| 5,823,100 A | * | 10/1998 | Wienhold et al. | 211/181.1 |
| 6,135,332 A | * | 10/2000 | Eleam | 211/195 |

FOREIGN PATENT DOCUMENTS

| | | |
|---|---|---|
| CH | 272645 | 12/1950 |
| FR | 2779211 | 12/1999 |
| GB | 415028 | 8/1934 |
| GB | 2222102 | 2/1990 |

* cited by examiner

*Primary Examiner*—Daniel P. Stodola
*Assistant Examiner*—Jennifer E. Novosad
(74) *Attorney, Agent, or Firm*—Steinberg & Baskin, P.C.

(57) ABSTRACT

A shelf comprising a base part (2) and at least one side (3) rigid with said base part, in which to enable the side (3) to be varied in position relative to the base part (2) and to maintain the position assumed, the side (3) and base part (2) are joined together by at least two deformable elements.

16 Claims, 4 Drawing Sheets

METAL WIRE SHELF WITH COLLAPSIBLE SIDES, PARTICULARLY FOR TROLLEYS AND THE LIKE

FIELD OF THE INVENTION

This invention relates to a collapsible-sided shelf, in particular of metal or non-metal wires, rods and rod-like elements, particularly for trolleys and fixed support devices.

BACKGROUND OF THE INVENTION

Shelves of plastic-coated metal wire, rods or rod-like elements are known, to be hooked at different heights to side walls provided or not provided with wheels, to form a trolley or a support device in which these (removable) shelves form a consolidating part of the trolley or device. These shelves comprise a substantially rectangular flat base part plus sides. The sides may form an integral part of the base part, in which case they are rigidly set substantially at 90° to the base part which, with the sides, assumes either a U-configuration, or a tray configuration if bounded by four sides. The overall size of such a shelf is considerable, and negatively affects transport and storage costs.

To reduce the overall size of such shelves it has already been proposed to provide them with collapsible sides which can be rotated from a substantially flat position lying on the base part to a position rotated through 90° therefrom. For this purpose the sides are provided with a number of rods, wires and rod-like elements shaped approximately as a half-closed hook which by engaging a surrounding rod of the base part enables the sides to be rotated away from and towards this base part.

Although this solution solves the size problem, it has certain drawbacks: the shelf is unstable and therefore also makes the trolley structure unstable; the shelf is uncomfortable to install between the side walls; and fitting the sides to the base part involves relatively complicated manual operations which cannot be automated.

An object of this invention is to provide a shelf provided with at least one side which forms one piece with the base part and can be made to manually assume a plurality of stable angular positions relative to said base part.

OBJECTS AND SUMMARY OF THE INVENTION

A further object of the invention is to provide a trolley or a fixed support structure in which the shelf of the invention is applied.

These and further objects which will be apparent from the ensuing detailed description are attained by a shelf and a trolley or support structure in accordance with the teachings of the accompanying claims.

BRIEF DESCRIPTION OF THE DRAWINGS

The invention will be more apparent from the detailed description of some preferred embodiments thereof given hereinafter by way of non-limiting example with reference to the accompanying drawings, on which.

DETAILED DESCRIPTION OF THE INVENTION

Figure 1:
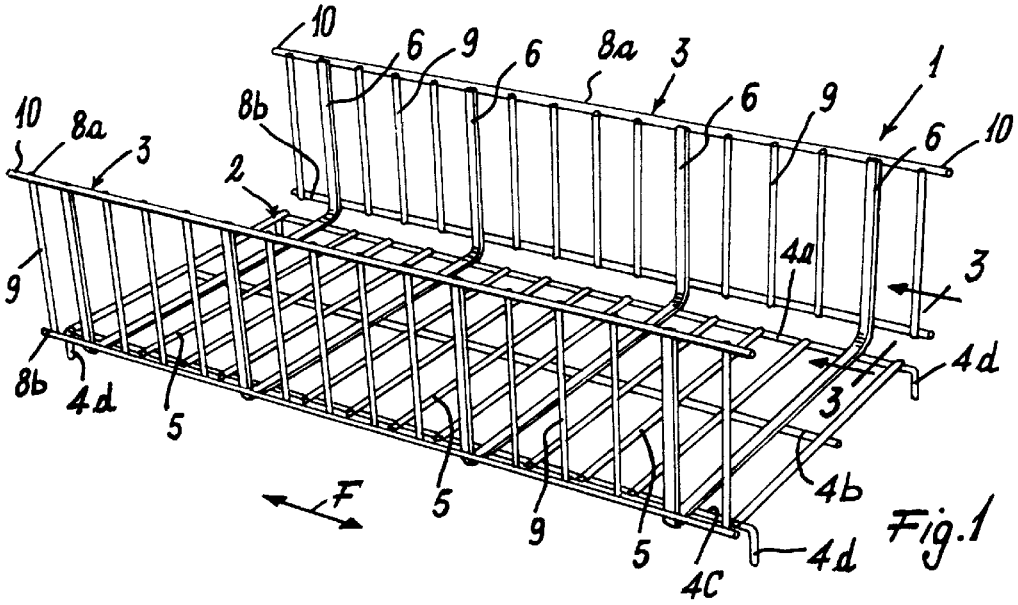
FIG. 1 is a perspective view of a shelf of the invention provided with two sides shown in their erect position.
Figure 2:
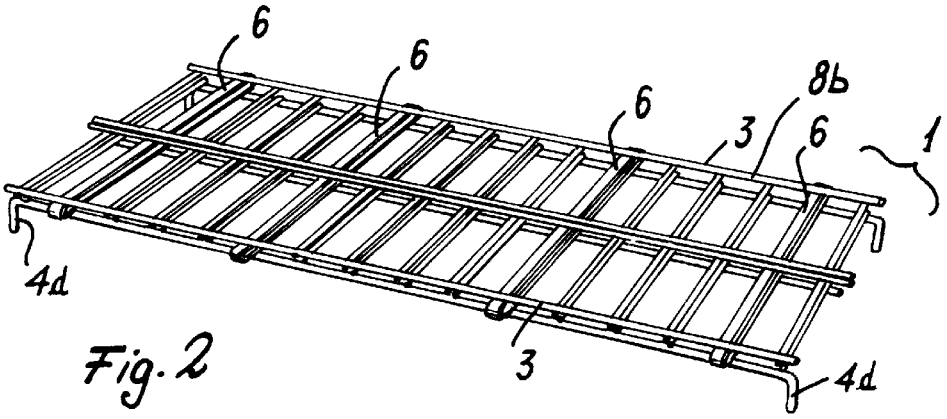
FIG. 2 is a perspective view of the shelf of the invention with its sides collapsed onto the base part.
Figure 3:
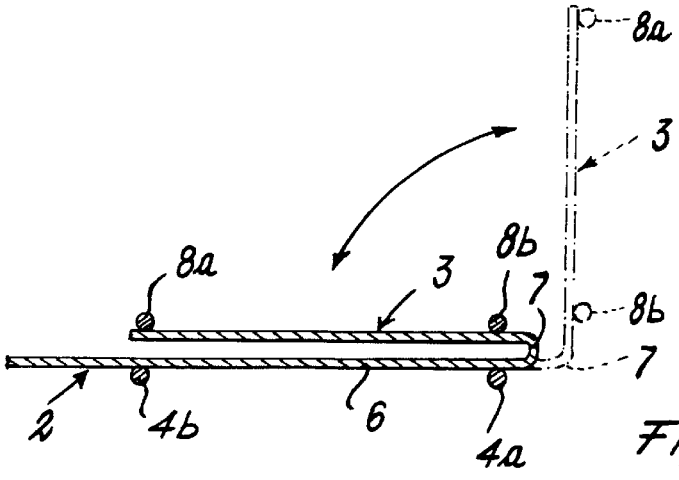
FIG. 3 is a partial section through the shelf taken on the line 3—3 of FIG. 1.

In the figures the reference numeral 1 indicates the shelf of the invention overall. It comprises a base part 2 and two sides 3 forming o n e piece with said base part. Both the base part 2 and the sides 3 are formed from metal or non-metal wires, rods or rod-like elements assembled together and surface-treated.

In particular, in the illustrated example, the base part 2 comprises three parallel longitudinal rod-like elements 4*a, b, c* (two side or outer elements 4*a, b,* bent at 90° at their outer ends at 4*d,* and one intermediate element 4*b*) and a series of parallel transverse rod-like elements 5 rigid with the three longitudinal rod-like elements 4*a, b, c.* The transverse elements 5 and longitudinal elements 4*a, b, c* involve only the base part 2.

Spaced between the transverse elements 5 and fixed to the longitudinal elements 4*a, b, c* of the base part 2, there are provided metal and non-metal elements of strap form, indicated by 6, which are parallel to each other and, in that portion fixed to the base part 2, also parallel to the transverse elements 5.

According to the invention these straps are prolonged beyond the base part 2 to extend into the sides 3 and form a part of the structure of these latter.

More specifically, those portions of said straps which extend beyond the base part 2 are fixed, after a certain suitable free spacing distance indicated by 7, to two (rod-like) parallel stringers 8*a, b* bounding the sides 3, these latter being completed by a series of parallel rod-like elements 9 also fixed to the stringers 8*a, b.* Advantageously, the outer stringers 8*b* project outwards at their ends (at 10).

The base part 2 and sides 3 hence form one piece which can be produced entirely automatically without manual intervention.

The material of the straps 6 is chosen such that the sides 3 can be made to assume any position relative to the base part 2 by being bent (in the opening or closure direction) manually and without particular force along their free portion 7, their assumed position persisting after the manual intervention ceases. The material is also chosen such that even after the position of the sides has been changed a certain number of times, the straps do not fracture within those free portions 7 in which the repeated bending occurs. Typical materials suitable both for bonding and for changing the position of the sides and their stability in the desired position are metals in general or other materials.

For example, steel wire covered with a thermosetting or thermoplastic plastic can be used.

The shape of the straps is such as to offer a low resistant moment to change in position of the sides (ie in the direction of side rotation relative to the base part) but to offer considerable resistance to any force exerted transversely to the straps in the direction of the arrows F of FIG. 1, so stabilizing not only the structure of the shelf but also, in consequence, the structure of the trolley or non-wheeled support structure to which the shelf is hooked or connected.

Figure 4:
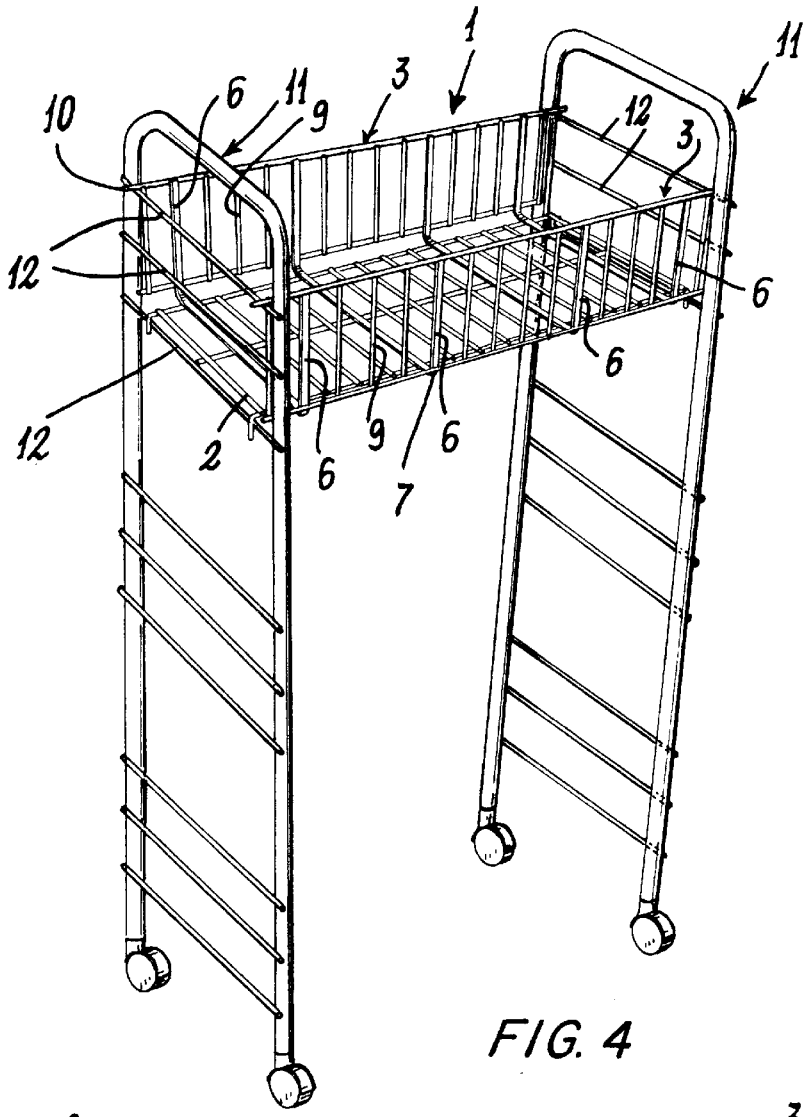
FIG. 4 is a perspective view of a trolley or non-wheeled structure in which a shelf of the invention is mounted.

In the case of a trolley or non-wheeled element comprising conventional side walls of inverted U-shape provided at different heights with groups of parallel crosspieces 12 joining together the legs of the U and rigid with them, as seen in FIG. 4, the shelf 1 of the invention is mounted (either with the sides 3 collapsed onto the base part or with the sides 3 raised) on said crosspieces 12 such that the bent appendices 4*d* of the base part lie on the outside of the crosspieces and the base part of the shelf rests on these latter. If collapsed, the sides are then rotated to assume a position at approximately 90° to the base part, whereas the projecting parts 10 of the outer stringers 8*a* of the sides engage the legs of the U to prevent any outward rotation of the sides should an accidental thrust be applied to them.

The scope of the invention includes different embodiments of the shelf and sides in terms of the number and arrangement of their constituent rods, wires or the like. Instead of having a mesh configuration, the shelf and its sides could be formed with solid flat elements connected together by straps or similar elements. The same applies to the number of straps 6 used, which could be reduced to two. The straps 6 could also be limited in length to just the portion 7 plus short extensions to enable it to be fixed to the sides 3 and to the base part 2.

Figure 5A:
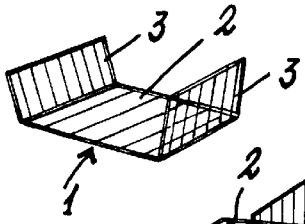
FIGS. 5*a, b, c, d, e* show schematically the different possible positions which the sides can assume relative to the base part.
Figure 5B:
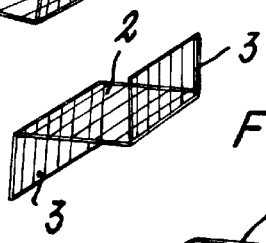
Figure 5C:
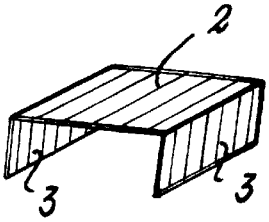

As can be seen from FIGS. 5*a, b, c, d, e,* the-proposed embodiment of the invention enables the sides 3 to be positioned in various spatial arrangements.

Figure 5D:
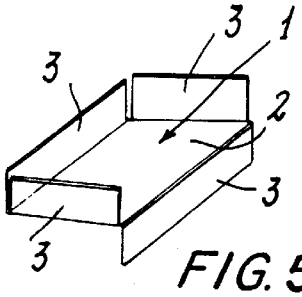
Figure 5E:
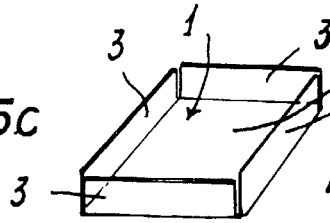

The number of sides could also be limited to one or be such as to totally surround the base part 2 (FIGS. 5*d* and 5*e*).

Figure 6A:
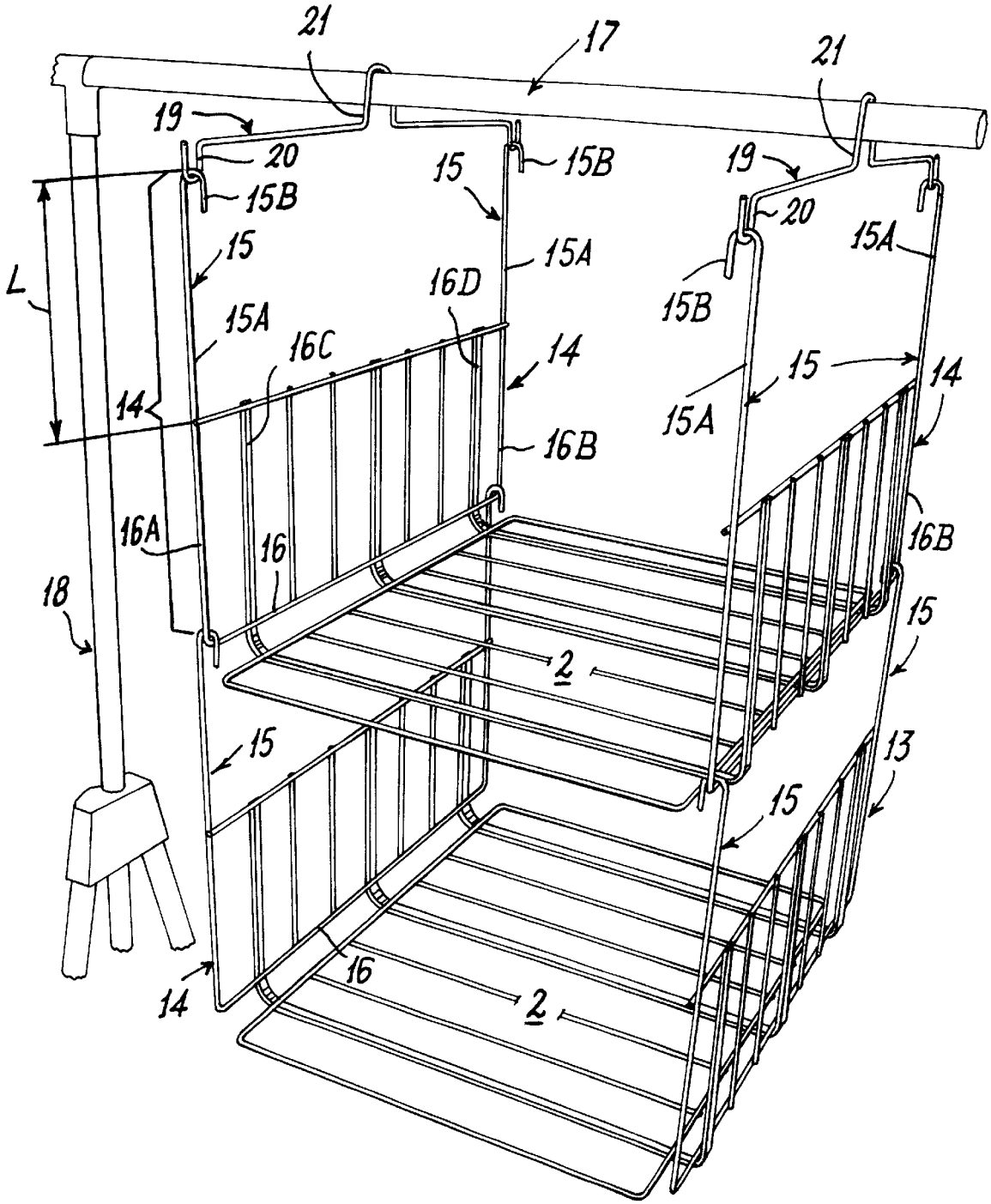
FIGS. 6*a,* 6*b* are two front perspective views of a further variant of a shelf according to the invention.

FIGS. 6*a,* 6*b* show a variant of the aforedescribed embodiments (those shelf parts in common with the aforedescribed embodiments are indicated by the same reference numerals thereas).

The shelf 13 of this variant is substantially identical to the lastly described embodiment and also comprises a base part 2 and sides 14 forming one piece with the base part, to which they are connected such as to enable their position to be modified as already described.

However, the sides 14 also comprise hooking elements 15, preferably provided on the ends of said sides.

The hooking elements 15 have a vertical part 15A and a hook-bent end part 15B. The hooking elements are preferably formed by prolonging the outside bars 16A, 16B defining the ends of the sides 14.

Figure 6B:
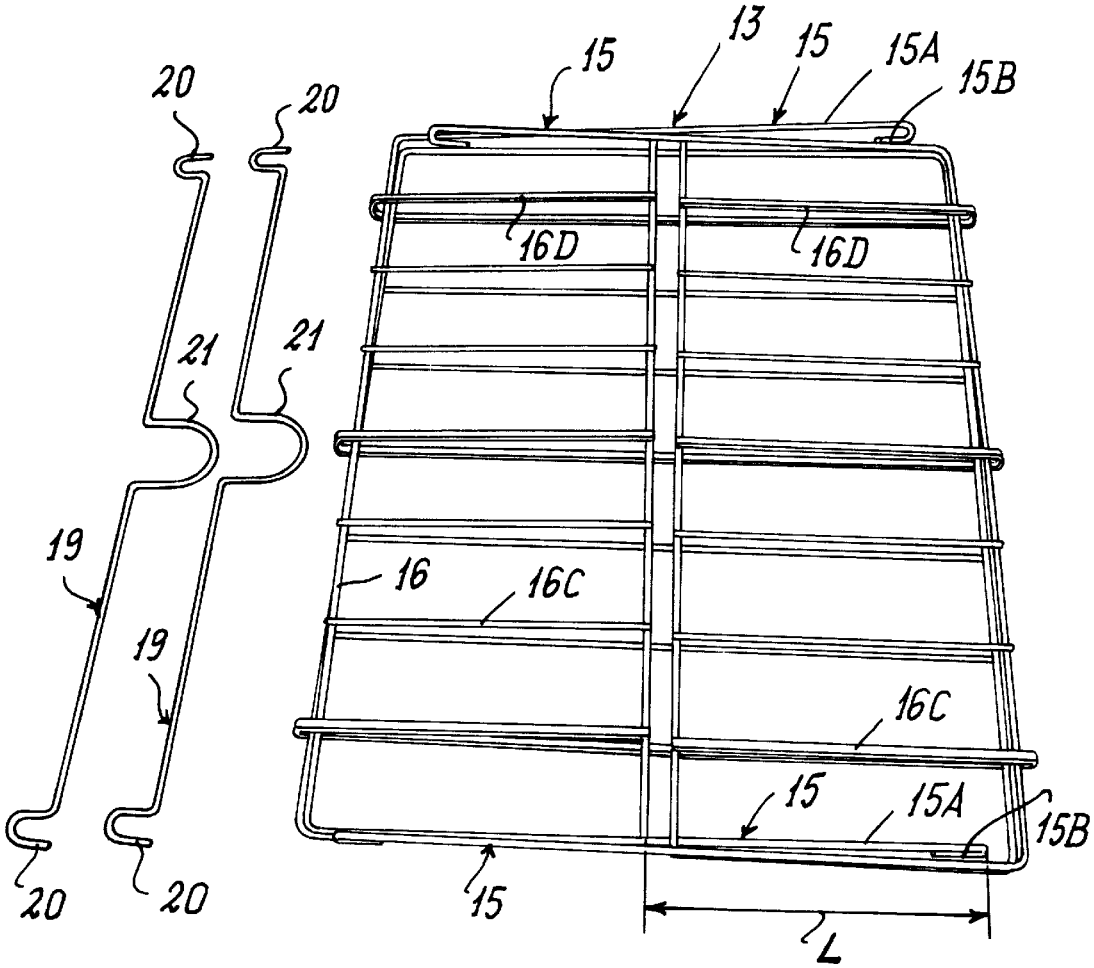

The length L of the hooking elements 15 is such that when the relative side 14 has been folded onto the base part 2 (FIG. 6B), said hooking elements 15 lie completely within the base part.

The hooking elements 15 are arranged to hook onto an overlying shelf by engaging a horizontal rod-like element 16 of a side 14 in the free space between the vertical end bars 16A, 16B of the side and the immediately adjacent vertical bars 16C, D.

To connect the shelves of this variant to a crosspiece 17, for example provided inside a cupboard or connected to a support structure 18 (partially shown in FIG. 6*a*), preferably also rod-like, hanging means 19 comprising bent ends 20 able to cooperate with the bent ends 15B of the hooking elements 15, and a central 21 part bent to straddle the crosspiece 17.

What is claimed is:

1. A shelf comprising:

at least two sides (3);

a base part (2);

a plurality of elongated deformable elements (6) coupled to each of said at least two sides and to said base part to thereby couple each of said sides and said base part to one another;

wherein said plurality of deformable elements (6) are formed of a material permitting the independent adjustment of each of said at least two sides from a position parallel and lying over said base part to any one of a plurality of other angular positions relative to an edge of said base part to which said side is adjacent and said material maintaining each of said at least two sides stable in said position to which said side is adjusted.

2. A shelf as claimed in claim 1, wherein the base part (2) and the at least two sides (3) are constructed of one of metal wires and rods.

3. A shelf as claimed in claim 1, wherein the base part (2) and the at least two sides (3) are constructed of one of non-metal wires and rods.

4. A shelf as claimed in claim 1, wherein the deformable elements (6) are straps.

5. A shelf as claimed in claim 4, wherein the straps (6) extend along the base part (2) and the at least two sides (3) and include an intermediate deformable part.

6. A shelf as claimed in claim 1, wherein said base part (2) comprises a plurality of resting members (4*d*) structured and arranged to enable said base part (2) to rest on top of an underlying support structure.

7. A shelf as claimed in claim 6, wherein each of the plurality of resting members is a hook (4*d*) which forms an angle of about 90°.

8. A shelf as claimed in claim 6, wherein each of the at least two sides is provided with hooking members (15), said hooking members being structured and arranged to enable each of said at least two sides to hook onto an overlying shelf.

9. A shelf as claimed in claim 8, wherein each of the hooking members (15) comprises a first straight part (15A) terminating with a terminal part (15B) bent as a hook.

10. A shelf as claimed in claim 9, further comprising at least two support elements (19) structured and arranged to be removably connected to a crosspiece (17), said support elements (19) each having end parts (20) shaped to cooperate with the terminal parts (15B) of the hooking elements, and a central part (21) shaped to straddle said crosspiece.

11. A shelf as claimed in claim 10, wherein each support element (19) is a rod.

12. A shelf as claimed in claim 8, wherein each of said at least two sides (14) includes end bars (16A, B) and each of the hooking members (15) is a prolongation of one of the end bars (16A, B).

13. A shelf as claimed in claim 3, wherein a length (L) of each of the hooking members (15) is such that when one of the at least two sides (14) is folded onto the base part (2) said hooking members (15) lie within said base part (2).

14. A shelf as claimed in claim 1, wherein at least the defonnable elements (6) are constructed of steel with a thermosetting or thermodefonnable plastic material.

15. A shelf as claimed in claim 1, wherein said shelf is mounted on at least one of a trolley or support device.

16. A trolley or support device comprising:

a first and second shelf, each of said shelves having at least two sides (3) and a base part (2), and a plurality of elongated deformable elements (6) coupled to each of said at least two sides and to said base part to thereby couple each of said sides and said base part to one another;

wherein said plurality of deformable elements (6) are formed of a material permitting the independent adjustment of each of said at least two sides from a position parallel and lying over said base part to any one of a plurality of other angular positions relative to an edge of said base part to which said side is adjacent, and said material maintaining each of said at least two sides stable in said position to which said side is adjusted.

* * * * *

UNITED STATES PATENT AND TRADEMARK OFFICE

CERTIFICATE OF CORRECTION

PATENT NO. : 6,497,331 B1
DATED : December 24, 2002
INVENTOR(S) : Ivano Morandi

It is certified that error appears in the above-identified patent and that said Letters Patent is hereby corrected as shown below:

Title page,
Item [30], Foreign Application Priority Data, change "MI0000A17" to
-- M12000A000017 --.

Signed and Sealed this

Twenty-ninth Day of April, 2003

JAMES E. ROGAN
*Director of the United States Patent and Trademark Office*